United States Patent [19]

Fautz

[11] Patent Number: 4,980,273

[45] Date of Patent: Dec. 25, 1990

[54] MATTED PHOTOGRAPHIC IMAGING MATERIALS

[75] Inventor: Manfred Fautz, Dreieich, Fed. Rep. of Germany

[73] Assignee: E. I. DuPont de Nemours and Company, Wilmington, Del.

[21] Appl. No.: 385,310

[22] Filed: Jul. 26, 1989

Related U.S. Application Data

[63] Continuation of Ser. No. 112,480, Oct. 26, 1987, abandoned.

[30] Foreign Application Priority Data

Jan. 10, 1987 [DE] Fed. Rep. of Germany ..... 3700551

[51] Int. Cl.[5] ..... G03C 1/32

[52] U.S. Cl. ..... 430/496; 430/138; 430/531; 430/533; 430/539; 430/621; 430/631; 430/950; 430/961; 430/141; 430/155; 430/158; 430/162

[58] Field of Search ..... 430/950, 961, 631, 621, 430/496, 138, 531, 533, 539

[56] References Cited

U.S. PATENT DOCUMENTS

| | | | |
|---|---|---|---|
| 2,822,272 | 2/1958 | Kosalek | 96/91 |
| 3,523,022 | 8/1970 | Byerley et al. | 96/74 |
| 3,632,342 | 1/1972 | Salesin et al. | 96/68 |
| 4,172,731 | 10/1979 | Heigold et al. | 98/48 R |
| 4,409,322 | 10/1983 | Ezaki et al. | 430/523 |
| 4,427,761 | 1/1984 | Charles | 430/291 |
| 4,430,415 | 2/1984 | Aono et al. | 430/203 |
| 4,529,681 | 7/1985 | Usami et al. | 430/138 |
| 4,598,035 | 7/1986 | Usami et al. | 430/138 |
| 4,708,928 | 11/1987 | Geisler | 430/619 |
| 4,855,219 | 8/1989 | Bagchi | 430/523 |
| 4,920,004 | 4/1990 | Bagchi | 430/950 |

*Primary Examiner*—Charles L. Bowers, Jr.

[57] ABSTRACT

The matting agent particles of matted photographic imaging materials contain a finely divided solid as well as a dye that is only present at the image-forming points after exposure and development of the material. The starry night effect is thereby avoided. The dye can be formed during exposure and development from a precursor, e.g., from silver halide or from couplers for color photography or for diazo processes.

8 Claims, No Drawings

MATTED PHOTOGRAPHIC IMAGING MATERIALS

This application is a continuation of application Ser. No. 07/112,480 filed 10/26/87, abandoned.

TECHNICAL FIELD

This invention relates to a photographic imaging material. More particularly this invention relates to a photographic imaging material having at least one layer containing a matting agent containing a dye which after exposing and processing the material the dye is present only at the image-forming areas.

BACKGROUND OF THE INVENTION

It is a widespread custom to endow the surfaces of photographic imaging materials with a certain roughness by means of special measures during production, in order to improve the physical properties that are important during use of the materials, such as. e.g., their tendency to electrostatic charge, their tendency to adhere to other smooth surfaces, their sensitivity to be scratched by dust particles, and their ability during vacuum frame copying to position themselves on the copy materials adequately, quickly and without forming Newton's rings. Although these measures do not always lead to a noticeable decrease in surface gloss, they are generally grouped under the term "matting".

In practical terms, the most important matting measure is the addition of finely divided solids to one or more of the coating solutions used during the production of the imaging materials.

A selection of suitable materials is listed in Research Disclosure 176 043 (December. 1978). Since the addition of matting agents as a rule not only improves the desired properties but also impairs others such as. e.g., clarity or slip, the quantity of the agents must be determined by a compromise based on the application of the imaging material.

If the imaging material is matted on a surface that lies on the same side of the layer support as a light-sensitive layer, a phenomenon called the "starry night" or "pinhole" effect is frequently observed, especially when the light-sensitive layer and the layer containing the matting agent are applied simultaneously. This causes pinhole-like light-permeable dots at the image-forming areas or points of the reproduction after exposure and processing. This effect leads, on the one hand, to a reduction in the average optical density over the imaging range, and on the other hand, to the falsification or destruction of fine structures such as, e.g., half-tone dots or lines of a mask, and is therefore extremely undesirable. It is assumed that this is caused by agglomerates or individual particularly large particles of the generally polydisperse matting agent, which displace the light-sensitive layer when the layer is still deformable during coating and drying.

U.S. Pat. No. 4,172.731 teaches that polymer particles whose color and light absorption is matched to the color of the image in the processed imaging material by means of incorporated pigments, can be used as matting agents. For black and white imaging with silver halide emulsions, for example, polymethyl methacrylate particles that contain carbon black as a pigment, are suggested. It is true that this avoids the starry night effect. The colored particles still present also at the clear points of the processed imaging material, however, cause a light absorption that appears as fog density. Thus, the quantity of matting agent to be added can not be determined by the desired physical properties, but is limited by the intended use of the imaging material.

Photographic imaging materials are known from U.S. Pat. No. 3,523.022 that contain spherical microcrystals of silver halide of between 0.5 and 10 μm in size, as matting agents in their protective layer. These microcrystals are made insensitive to light for this purpose, however. Since they are used in exactly the same way as other matting agents such as, e.g., polymethyl methacrylate spheres or silicon dioxide particles, the starry night effect can not be avoided by the teaching given in this patent.

An object of the invention is to give matted photographic imaging materials that do not exhibit a starry night effect and in which any required degree of matting can be established without impairing the photographic properties.

SUMMARY OF THE INVENTION

In accordance with this invention there is provided a photographic light-sensitive imaging material having a support bearing at least one layer containing a matting agent having a particle size of 1 to 30 μm, the particles of matting agent containing (a) a binder and optionally a hardener therefore, and (b) a dye, the improvement wherein the particles also contain (c) a finely divided solid, and after exposure and processing of the imaging material, the dye is present only at the image-forming points.

EMBODIMENTS OF THE INVENTION

According to the main claim, any degree of matting desired can be established without the occurrence of the starry night effect and without increasing the fog, in photographic imaging materials matted with a matting agent containing a binder and a dye, if the particles of the matting agent contain a finely divided solid and contain the dye only at the image-forming points of the reproduction after exposure and processing. "Dyes" are to be understood here to mean both organic and inorganic dyes and pigments with the inclusion of finely divided metals such as. e.g., silver. "Image-forming points" are understood here to mean the points of the imaging material whose optical density after exposure and developing is greater than the lowest density occurring in the reproduction. For negative materials these are points whose exposure was greater than a material-dependent threshold, but with positive materials they are points whose exposure was lower than a threshold value. This makes it clear that the field of application of the invention is not limited to negative materials, but can also, of course, be extended to direct positive materials. An imaging material with these properties cannot be found in the state of the art.

Photographic imaging materials matted according to the invention and having the desired properties can be produced. e.g., by incorporating the precursor of a dye. e.g., light-sensitive constituents of the imaging layer, into the particles of the matting material. If the light-sensitivity of these light-sensitive constituents in the matting agent approximately matches that of the imaging layer, the matting particles are dyed after exposure and development only at the image-forming points, and optically hide the pinholes produced by them at those points. At the nonimage points of the reproduction.

where no exposure took place, on the other hand, the matting particles Will be colorless.

It could not be anticipated that such matting agents could be produced. In the methods for the production of matting agents from colloidal binders described in the state of the art, these binders are exposed regularly to physical influences (e.g., heat) or chemical influences (e.g., hardeners, surfactants). The light-sensitive constituents of the imaging materials are metastable systems, however, whose properties are changed as a rule uncontrollably, not only by light, but also by other physical or chemical influences. For this reason, U.S. Pat. No. 3,523,022, for example, recommends the use of a desensitized silver halide.

In a preferred form of an embodiment, the matting agents contain silver halide as the precursor of the dye. The term "silver halide" is intended here to include both any pure silver halide desired and mixtures of various silver halides. Such matting agents are particularly suitable for silver halide imaging layers. The particle size of the silver halide is adjusted in the known manner so that the required light sensitivity can be achieved. It must, of course, be smaller than that of the finished matting agent, particle diameters up to 1 μm are sufficient.

It is possible to produce the silver halide by methods known for the obtaining of photographic emulsions, e.g., from Research Disclosure 176043, Chapter I (December. 1978). In this case, the dispersing agent used to produce the emulsion. e.g., gelatin, may already be a suitable colloidal binder for the matting agent. Further portions of the same or a different binder above and beyond this quantity can also be added, however, in order to be able to adjust the binder portion of the matting agent independently.

The finely divided solid can be added to this silver halide emulsion. It is also possible, however, to undertake the silver halide precipitation with the finely divided solid already present.

To establish the necessary light-sensitivity, the silver halide must, as a rule, be chemically sensitized. Methods for this are described, e.g., in Research Disclosure 176043. Chapter III (December,1978).

The term "approximately matching sensitivity" also refers to the spectral sensitivity of the imaging material and the matting agent. It may therefore be necessary to sensitize the silver halide by adding optical sensitizers for certain regions of the spectrum.

In a particularly simple form of embodiment of the invention, the same silver halide emulsion is used as a starting material in the production of the matting agent as was used to produce the imaging layer to be matted, and a suitable finely divided solid is added to this.

In producing the matting agent, the simplest method is to start with liquid dispersions that contain the binder and the finely diVided solid as well as the dye or the precursor of the dye. These dispersions are preferably subjected to spray drying after a hardener has been added to them, if required. It is likewise possible, however, to produce a matting agent by an emulsifying technique according to German preliminary published Application No. 2,522,692, whereby the liquid dispersion is used as an aqueous or oily phase, according to its type, and the optionally necessary hardener is added after production of the emulsion. Another method of producing a matting agent from the liquid dispersion is the conservation method, as described in Japanese Patent No. 71-001/796 (cited by Derwent Abstract 71053295/03).

It may be necessary to subject the matting agent to a classifying process before its use, if its particle size distribution is too wide from the point of view of its use. Air separation is suitable for this, for example.

As the precursor of the dye, not only light-sensitive substances are suitable, but also other materials that react differently in the course of the photographic process at image-forming and nonimage-forming points and thereby change color in the required manner. Thus, the invention can also be carried out with silver halide imaging materials by incorporating couplers, e.g., color-photography couplers, into the particles of the matting agent that are capable of reacting with the oxidation products of the developer substance during the developing process, forming dyes. In order to fix these dyes in the particles of the matting agent, it is preferable to use diffusion-resistant couplers whose molecule contains a larger hydrophobic group, e.g., an alkyl group with more than 8 carbon atoms. A large number of such couplers for developers, both of the p-phenylenediamine type and of the p-aminophenol type, are known to those skilled in the art; examples for the subtractive primary colors, yellow, cyan, and magenta, are given by T. H. James. "The Theory of the photographic process", 4th Edition. p. 354 ff.

If the matting agent particles are produced from an aqueous solution, the diffusion-resistant water-insoluble couplers are expediently dissolved in an organic solvent, e.g., di-n-butyl phthalate, and this solution is emulsified in the aqueous solution, using an emulsifier.

The coupler is preferably selected in such a way that the color of the matting agent after development matches as far as possible that of the image in the imaging layer. Accordingly, matting agents for black images contain mixtures of yellow-, cyan-, and magenta couplers.

As finely divided solids, both inorganic and organic materials can be used that can be produced in the form of sufficiently fine dispersions with a particle size distinctly below that of the finished matting agent. They must be insoluble in the liquids used during the production of the matting agent and must not have a permanent self-color. Examples to be mentioned are: silicon dioxide, silica xerogels, aluminum oxide, barium sulfate, lead sulfate, calcium carbonate, zinc oxide titanium dioxide, polymethyl methacrylate, polystyrene, polyethylene, etc.

Binders that can be used as a constituent of the matting agent of the invention are listed, for example, in Research Disclosure 176 043, Chapter IX (December. 1978). If silver halide is used as the light-sensitive substance, gelatin and other proteins and their derivatives are preferred as the binder.

If the binder is soluble or extremely swellable in the coating solution to which the matting agent is to be added, it must be cross-linked and therefore made insoluble by adding a hardener during the production of the matting agent.

The selection of the hardener is governed by the type of binder used. For proteins such as, e.g., gelatin, suitable hardeners are named in Research Disclosure 176 043. Chapter X (December. 1978) and in T. H. James. "The Theory of the Photographic Process", 4th Edition, p. 77 ff. In this case. formaldehyde and free aliphatic dialdehydes such as, e.g., glutaraldehyde and succinaldehyde, are preferred. Borates are suitable, for example, for hardening polyvinyl alcohol.

The field of application of the invention is not limited to silver halide-containing imaging materials, photoprinting films based on two-component diazo systems and matted according to the invention can also be produced, for example. For these, a matting agent according to the invention whose particles contain not only a binder and a finely divided solid but also both components of the light-sensitive diazo system. i.e., diazonium salt and coupling component, is added to the coating solution for the light-sensitive layer and/or for a polymer undercoat. If a binder is selected that is insoluble in the solvent of the coating solutions no particular hardener is required. Such a selection, e.g., from the group of cellulose esters of aliphatic carboxylic acids frequently used in diazo materials, is simple for those skilled in the art. To produce the matting agent, a different solvent from the one used for the coating solutions must be used, in this the binder selected for the matting agent can be dissolved. Examples of suitable diazonium salts and coupling components are listed in German Patents Nos. 2,932,003 and 3221,643, as well as in "Light Sensitive Systems" by J. Kosar, New York 1965, p. 201 ff.

Photographic imaging materials according to the invention can be used in many fields, e.g., in reproduction technology, in medical diagnostic X-rays, in materials testing with X-rays in the recording of computer output, and in microfilm documentation. They can contain the matting agent both in the light-sensitive layer and in nonlight-sensitive overcoat or undercoat layers. It is thereby preferred that all the layers assigned to one side of the layer support be applied simultaneously. i.e., in a single passage through the coating device.

EXAMPLES

The following model examples are intended to give a more detailed explanation of the production and properties of the photographic imaging materials of the invention. The percentages are by weight unless indicated.

Example 1

Production of a Matting Agent

A silver chlorobromide emulsion with an 80 mol-% chloride portion and an average grain size of 0.15 μm was produced by an unregulated twin-jet inlet and was freed of soluble salts by the flocculation method. The emulsion was chemically sensitized with thiosulfate and gold salt spectrally sensitized by adding a green-sensitizing dye, and 0.28 g of an anionic octyl phenyl ethoxylate wetting agent was added per kg. It then contained 55 g of silver and 40 g of gelatin per kg.

100 g of this emulsion were agitated intensively at 40° C. for 1 hour with 240 g of a 5% silica sol (primary particle size 14 nm. stabilized with Al $(OH)_3$) and 1 g of 37% formaldehyde solution, and were then sprayed in a spray drier and dried, whereby the temperature of the drying air was 200° C. at the entrance and 80° C. at the exit. Particles with a diameter greater than 20 μm were separated by means of an air classifier (type MZR, Alpine, Augsburg), 14 g of a ready-to-use matting agent were obtained.

Example 2

Production of a Matting Agent

Another 100 g of the chemically and spectrally sensitized silver chlorobromide emulsion used in Example 1 were mixed with a dispersion of 4 g of fumed silica (primary particle size 12 nm) in 200 g of water as well as with 1.5 g of 37% formaldehyde solution and were agitated at 40° C. for 1 hour. The dispersion was subject to spray drying and separation as in Example 1, whereby particles with a diameter over 10 μm were separated. 10 g of a ready-to-use matting agent were obtained.

Example 3

Production of a Matting Agent

A silver bromoiodide emulsion having an iodide portion of 1.8 mol-% was produced by the single-jet method and was subjected to Ostwald ripening in the presence of ammonia until the average grain size was 0.8 μm. After separation of the soluble salts and chemical sensitization, the emulsion received 75 g of silver and 60 g of gelatin per kg and 0.75 g of saponin were added per kg.

100 g of this emulsion were agitated intensively for 1 hour at 40° C. with a suspension of 3 g of fumed silica (primary particle size 12 nm) in 200 g of water as well as with 1.5 g of 37% formaldehyde solution. By spray drying and separating as in Example 1. 16 g of a ready-to-use matting agent were obtained.

Example 4

Matted Imaging Material

In a "bead coating apparatus" for the production of photographic imaging materials, the following layers were applied simultaneously onto a 100 μm thick polyethylene terephthalate layer support provided with an antihalation backing at a web speed of 75 m/minute:

1. Silver chlorobromide emulsion of Example 1 with a silver coating weight of 3.4 g/m$^2$,
2. Gelatin protective overcoat layer with a coating weight of 0.6g/m$^2$, which contained one of the following matting agents:
   - Test A: matting agent of the invention, produced according to Example 2.
   - Test B: fumed silica with a primary particle size of 12 nm and an average secondary particle size of 2 μm (TS-100, Degussa).
   - Test C: in order to produce a matting agent with the effect of the pigmented agent described in U.S. Pat. No. 4,172,731, the matting agent of Example 2 was exposed before use. After the imaging material had been processed, all the matting particles contained black developed silver.

In order to take into consideration the varying space occupied by the matting agents to be compared with one another, the applied amounts were determined so that the volume percentages of the matting particles in the dried layer were the same.

High-gradation films were obtained, which were tested as described below for presence of the starry night effect, fog, and effectiveness of the matting during use of the film in a vacuum frame.

Testing for starry night: first the exposure required for the imaging material to be tested is determined, by copying an original containing various tonal value gradations of a screen with 60 lines/cm onto the emulsion side of the imaging material at various exposure times. The required exposure time is considered to be the time at which the 80%. 39%. and 7% tonal values are reproduced at 20±1%, 61±2%, or 93±1%, respectively. A required exposure for photoprinting through the antihalation backing on the back of the imaging material is determined in a corresponding manner.

Next, a sample sheet at least 24×30 cm in size is exposed without an original both from the emulsion side and from the back at half the required exposure respectively. (This avoids problems due to dust particles.)

The density is measured at five points in the middle of this exposed and developed film sheet using a transmission densitometer with a measuring aperture 3 mm in diameter. The average value of the test results is given as Dmax. The higher the average of the test results, the lower the starry night effect.

5×10 cm pieces are cut from the center of all test sheets. Up to 6 such film samples are mounted to form a copy original. This original is copied onto a camera speed orthochromatic lith film with a metal halide lamp at an illumination of 15 000 Lx and 5 s exposure time. The average density of the print, minus the fog density, is called DK and is a measurement for the starry night effect.

In this test method, all the samples to be compared are processed under the same conditions appropriate to the emulsion type. The photoprint film is always developed automatically in a lith developer.

Testing for matting effectiveness: in a vacuum frame, a 30×40 cm sheet of the sample is covered with a 50×60 cm copy original that represents a uniform halftone of 40% at 60 lines/cm. After suction has been applied, there is a difference in the thickness of the air gap between the original and the sample at various points; the brightness appears to the naked eye to vary at these points. Visual observation is continued and the time between the point at which the vacuum is switched on and the point at which the brightness differences disappear, is measured. This time is called the suction time. It decreases as the effectiveness of the matting increases.

Testing for fog (Dmin): an unexposed sheet of the sample is processed in the same manner as in the starry night test and the density is measured with a transmission densitometer.

The test results are shown in Table 1.

TABLE 1

| | Sample | | |
|---|---|---|---|
| Matting agent | A According to Example 2 | B Fumed silica | C According to Example 2 but preexposed |
| Coating weight of the matting agent (mg/m$^2$) | 120 | 16 | 120 |
| Volume of matting agent applied (mm$^3$/m$^2$) | 34 | 34 | 34 |
| Dmin | 0.03 | 0.03 | 0.05 |
| Dmax | 5.9 | 4.6 | 5.9 |
| DK | 0.01 | 0.08 | 0.01 |

TABLE 1-continued

| | Sample | | |
|---|---|---|---|
| Matting agent | A According to Example 2 | B Fumed silica | C According to Example 2 but preexposed |
| Suction time (s) | 8.5 | 8.4 | 8.5 |

The results show that almost no starry night effect occurs when either the matting agent of the invention (Sample A) or the agent according to U.S. Pat. No. 4,172,731 (Sample C) are used, whereas Sample B (with a conventional matting agent) is not usable. Sample C is likewise unusable for photoprinting, however, due to its distinctly higher fog.

I claim:

1. A photographic light-sensitive silver halide imaging material substantially free of starry night effect having a support bearing at least one layer selected from the group consisting of a silver halide imaging layer comprising a silver halide emulsion, a silver halide imaging layer comprising a silver halide emulsion and a nonlight-sensitive undercoat layer, a silver halide imaging layer comprising a silver halide emulsion and image layer comprising a silver halide emulsion and a nonlight-sensitive undercoat and a nonlight-sensitive overcoat layer, at least one layer of said material selected from the group consisting of silver halide imaging layer, nonlight-sensitive undercoat layer and nonlight-sensitive overcoat layer containing a color changing matting agent having a particle size of 1 to 30 μm, the particles of matting agent consisting essentially of
   (a) a binder and optionally a hardener therefore, and
   (b) a precursor of a dye which is a chemically or chemically and spectrally sensitized silver halide whose sensitivity substantially matches that of the imaging layer, and
   (c) a finely divided solid not having a permanent self color with a particle size distinctly less than that of said color changing matting agent, and after exposure and processing of the imaging material, the dyed matting agent is present only at the image-forming points and the matting agent in the non-image points is colorless.

2. An imaging material according to claim 1 wherein the matting agent particles contain a hydrophilic colloidal binder and a hardener suitable for said binder.

3. An imaging material according to claim 2 wherein the hydrophilic colloid binder is gelatin.

4. An imaging material according to claim 3 wherein the particles of the matting agent comprise an emulsion prepared by precipitation of silver halide in the presence of nonlight-sensitive finely divided solid and subsequent chemical or chemical and spectral sensitization.

5. An imaging material according to claim 1 wherein the precursor of the dye is a color-photography coupler.

6. An imaging material according to claim 1 wherein the particles of the matting agent contain a nonlight-sensitive solid selected from the group consisting of silicon dioxide, silica xerogel, and aluminum oxide.

7. An imaging material according to claim 1 wherein the support bears in turn a light-sensitive silver halide emulsion layer and a colloid-containing overcoat layer, the matting agent being present in the overcoat layer.

8. An imaging material according to claim 1 wherein the matting agent is present in the silver halide imaging layer.

* * * * *